US012320251B2

(12) United States Patent
Nguyen et al.

(10) Patent No.: US 12,320,251 B2
(45) Date of Patent: Jun. 3, 2025

(54) DETECTION AND CORRECTION OF FALSE POSITIVE CLASSIFICATIONS FROM A PRODUCT SAND DETECTION TOOL

(71) Applicant: Schlumberger Technology Corporation, Sugar Land, TX (US)

(72) Inventors: Thanh Nhan Nguyen, Clamart (FR); Josselin Kherroubi, Clamart (FR); Clement Laplane, Houston, TX (US); Maxime Nollet, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/714,978

(22) PCT Filed: Jan. 24, 2023

(86) PCT No.: PCT/US2023/011388
§ 371 (c)(1),
(2) Date: May 30, 2024

(87) PCT Pub. No.: WO2023/146833
PCT Pub. Date: Aug. 3, 2023

(65) Prior Publication Data

US 2024/0418078 A1 Dec. 19, 2024

(30) Foreign Application Priority Data

Jan. 28, 2022 (FR) ..... 2200737

(51) Int. Cl.
*E21B 47/10* (2012.01)

(52) U.S. Cl.
CPC ..... *E21B 47/10* (2013.01); *E21B 2200/22* (2020.05)

(58) Field of Classification Search
CPC ..... E21B 47/10; E21B 2200/22
See application file for complete search history.

(56) References Cited

U.S. PATENT DOCUMENTS

2009/0055098 A1 2/2009 Mese
2019/0003303 A1 1/2019 Donzier
(Continued)

FOREIGN PATENT DOCUMENTS

WO WO-2019038401 A1 * 2/2019 ..... E21B 43/04

OTHER PUBLICATIONS

Appalonov et al. "Advanced Data Recognition Technique for Real-Time Sand Monitoring Systems" (Year: 2021).*
(Continued)

*Primary Examiner* — Rehana Perveen
*Assistant Examiner* — Troy A Maust
(74) *Attorney, Agent, or Firm* — Jeffrey D. Frantz

(57) ABSTRACT

Methods, computing systems, and machine-readable media for detecting downhole sand entry points are provided. A computing device receives a sand detection output of a product sand detection tool and a raw timeseries waveform corresponding to an input to the product sand detection tool. Based on the sand detection output, at least one downhole sand entry point is detected at a logging depth. In response to the detecting of the at least one downhole sand entry point, the computing device extracts a subset of features based on the raw timeseries waveform. The computing device determines whether the detecting is a true positive or a false positive based on the extracted subset of the features and a trained Random Forest classifier. A remedial action is performed regarding the at least one downhole sand entry point responsive to the determining that the detecting is the true positive.

14 Claims, 9 Drawing Sheets

(56) References Cited

U.S. PATENT DOCUMENTS

| | | | | |
|---|---|---|---|---|
| 2020/0134803 | A1* | 4/2020 | Gong | G06T 7/0002 |
| 2020/0200000 | A1 | 6/2020 | Langnes | |
| 2020/0355838 | A1* | 11/2020 | Venna | G01V 1/306 |
| 2021/0397994 | A1* | 12/2021 | Cerrahoglu | E21B 47/00 |

OTHER PUBLICATIONS

Menshawy et al. "An automatic mobile-health based approach for EEG epileptic seizures detection" (Year: 2015).*
Bruns "Fourier-, Hilbert- and wavelet-based signal analysis: are they really different approaches?" Journal of Neuroscience Methods 137 (2004) 321-332 (Year: 2004).*
Vieira et al. "Prediction of Threshold Sand Rates from Acoustic Monitors Using Artificial Intelligence" (Year: 2021).*
Aslanyan et al.; "Determination of Sand Production Intervals in Unconsolidated Sandstone Reservoirs Using Spectral Acoustic Logging"; SPE-196445-MS; SPE Conference Oct. 29-31, 2019; 12 pages.
Appalonov et al.; "Advanced Data Recognition Technique for Real-Time Sand Monitoring Systems"; Kazan Federal Univeristy, Russia; Dec. 31, 2021; 12 pages.
Kherroubi et al.; "Automation of Well Integrity Operations: Machine Learning Framework for Diagnosis of Ultrasonic Waveforms"; Society of Exploration Geophysicists; Sep. 30, 2020; 5 pages.
French Search Report received in Application No. FR2200737; Dated Oct. 21, 2022; 18 pages.
Search Report and Written Opinion of International Patent Application No. PCT/US2023/011388; Dated Apr. 27, 2023; 8 pages.
Breiman, L., "Random Forests", Machine Learning, 2001, 45, pp. 5-32.
Cortes, C. et al., "Support-Vector Networks", Machine Learning, 1995, 20(3) pp. 273-297.
Costa, I. G. et al., "Constrained mixture estimation for analysis and robust classification of clinical time series", Bioinformatics 2009, 25, pp. i6-i14.
Cox, D. R. "The Regression Analysis of Binary Sequences," Journal of the Royal Statistical Society, Series B: Methodology, 1958, 20, pp. 215-242.
Esmael, B., et al., "A Statistical Feature-Based Approach for Operations Recognition in Drilling Time Series", International Journal of Computer Information Sysems and Industrial Management Applications, 2013, 5, pp. 454-461.
Guerts, P., "Pattern Extraction for Time Series Classification", in: European Conference on Principles of Data Mining and Knowledge Discovery, Springer, 2001, pp. 115-127.
Ismail Fawaz, H. et al. "Deep Learning for Time Series Classification: a Review", Data Mining and Knowledge Discovery, 2019, 33, pp. 917-963.
Jahankhani, P. et al., "EEG Signal Classification Using Wavelet Feature Extraction and Neural Networks," IEEE John Vincent Atanasoff 2006 International Symposium on Modern Computing (JVA06), IEEE, 2006, 5 pages.
Ribeiro, M. T. et al., "Why Should I Trust You Explaining the Predictions of Any Classifier", Proceedings of the 22nd ACM SIGKDD International Conference on Knowledge Discovery and data mining. 2016, 10 pages.
Rodriguez, J. J. et al., "Support vector machines of interval-based features for time series classification," Knowledge-Based Systems, 2005, 18(4-5) pp. 171-178.
Sanchez Gonzalez, A., "Non parametric and robust statistical test based on wavelets for time series classification", MS thesis. Universidad EAFIT, 2018, 28 pages.
Zhao, X., "Prediction of Panel and Streaming Data using Wavelet Transform-based Decision Trees." Diss. University of Leeds, 2018, 162 pages.

* cited by examiner

*Notation:*

- *acf: autocorrelation function*
- *pacf: partial autocorrelation function*
- *diff: first derivative/differentiate (x[t+1]-x[t])*
- FFT: Fast Fourrier Transform
- wl: wavelet
- PSD: power spectrum density
- dis: distance
- pos: position
- Pos: positive
- Neg: negative

| **Prob. Detection** | *std_neg_diff* | *wl_std_diff* | *wl_zero_cross_diff* | *mean_5acf* | *mean5_pacf* |
|---|---|---|---|---|---|
| *std_neg_diff* | | 38.29 | 44.44 | 71.63 | 67.06 |
| *wl_std_diff* | 38.29 | | 44.05 | 74.6 | 69.64 |
| *wl_zero_cross_diff* | 44.44 | 44.05 | | 53.37 | 53.77 |
| *mean_5acf* | 71.63 | 74.6 | 53.37 | | 67.86 |
| *mean_5pacf* | 67.06 | 69.64 | 53.77 | 67.86 | |
| Average | 53.355 | 56.645 | 48.9075 | 66.865 | 64.5825 |

FIG. 7

DETECTION AND CORRECTION OF FALSE POSITIVE CLASSIFICATIONS FROM A PRODUCT SAND DETECTION TOOL

BACKGROUND

This application is the National Stage Entry of International Application No. PCT/US2023/011388, filed Jan. 24, 2023, which claims the benefit of French Patent Application No. FR2200737 entitled "Detection and Correction of False Positive Classifications from a Product Sand Detection Tool," filed Jan. 28, 2022, the disclosure of which is incorporated herein by reference in its entirety.

BACKGROUND

Timeseries classification plays an important role in the oil and gas industry as well as many other disciplines such as speech recognition, finance and medicine. Generally, timeseries classification techniques can be divided into feature-based and distance-based approaches.

In feature-based approaches, a feature extraction procedure is performed before a classification phase, whereas distance-based approaches have no feature extraction phase due to defined suitable distances through which the classification phase is carried out.

In distance-based approaches, distances can be computed over a raw or reduced representation or over decomposed coefficients (e.g. Fourier transform) of a timeseries. However performance of the distance-based approaches strongly depends on a quality of the timeseries alignment. Product sand detection tool (PSDT) signals have a low structural characteristic because sand inject events and a number of impacting sands, as well as many other factors in a downhole environment, are quite random. Consequently, distance-based approaches may not work effectively for detecting downhole sand entry occurrences.

In feature-based approaches, features such as, for example, mean, variance, maximum, minimum, entropy, power spectrum density, Fourier coefficients, autocorrelation function, etc., which capture statistics of signals that identify a certain class can be analyzed. A main advantage of the feature-based approaches is compact representation of a signal. However, because real-world signals tend not to be stationary due to a number of unpredictable factors, many more features may be required to capture informative content. Therefore, feature formulation and selection is very important when using feature-based approaches.

Use of a wavelet transform is another approach for exploiting time structure features. By using a wavelet transform, a timeseries waveform can be separated into "signal" and "noise" components, which can be used to obtain more informative features for classification purposes. Because PSDT waveforms at a sand inject entry point include specific patterns, the wavelet transform may be used to formulate some features.

Using a contemporary approach of deep learning for timeseries classification, which could be considered as an automatic learning feature-based approach, may be a good approach for detecting downhole sand entry points. However, this approach would require a large and well labeled data set and supporting hardware and software computational resources.

A classification model can easily be found in literature such as, for example, k-nearest neighbor, support vector machines, decision trees, random forest, logistic regression, and deep neural networks. Although these methods may perform differently, selection of these methods for a feature-based approach is mostly a grid search.

SUMMARY

Embodiments of the disclosure may provide a method for detecting downhole sand entry points. A computing device receives a sand detection output of a product sand detection tool and a raw timeseries waveform corresponding to an input to the product sand detection tool. The computing device detects at least one downhole sand entry point at a logging depth based on the sand detection output of the product sand detection tool. In response to the detecting of the at least one downhole sand entry point, the computing device extracts a subset of features based on the raw timeseries waveform. The computing device determines whether the detecting of the at least one downhole sand entry point is a true positive or a false positive based on the extracted subset of the features and a trained Random Forest classifier. In response to determining that the detecting is the true positive, a remedial action is performed regarding the at least one downhole sand entry point.

In an embodiment, the method may include training a Random Forest classifier to produce the trained Random Forest classifier. The training of the Random Forest classifier includes the computing device randomly selecting the features based on the raw timeseries waveform to produce the subset of the features. The computing device determines which paired features of the subset of features have a higher average detection probability than others of the paired features based on using a training set of the features and known sand entry point outcomes. The computing device constructs the trained Random Forest classifier based on multiple decision trees, each of which is based on a respective pair of the paired features of the subset of features having the higher average detection probability.

In an embodiment, the method may include the computing device eliminating, as candidates for the subset of features, the features with a single unique value, the features with a correlation magnitude greater than 0.9 with respect to another of the features, and the features that do not contribute to a cumulative importance of at least 0.9. The randomly selecting of the features based on the raw timeseries waveform to produce the subset of the features includes randomly selecting the subset of features from the features not eliminated as the candidates for the subset of features.

In an embodiment, the method may include the computing device determining a probability of sand entry point detection based on decision trees formed from each feature of the subset of features paired with another feature of the subset of features. The computing device determines an average probability of sand entry point detection of each of the decision trees that pairs a same one of the subset of features with each different respective feature of the subset features. The computing device then may determine which of the decision trees that pairs the same one of the subset of features with each different respective feature of the subset of features has a highest average probability of the sand entry point detection. A pair of the subset of features is selected for the decision trees of the trained Random Forest classifier from the same one of the subset of features and the each different one of the subset of features for the decision trees having the highest average probability of the sand entry point detection.

In an embodiment of the method, the output of the product sand detection tool is more likely to report a false positive regarding detection of the downhole sand entry point than a true positive.

In an embodiment, the method may include the computing device creating a wavelet transform of the raw timeseries waveform. A noise portion of the wavelet transform is extracted and at least some of the features are extracted based on the noise portion of the wavelet transform.

In an embodiment of the method, the extracted features may include frequency domain features, basic features, and wavelet-based features.

Embodiments of the disclosure may also provide a computing system for detecting downhole sand entry points. The computing system includes at least one processor and a memory connected with the at least one processor. The memory includes instructions for configuring the computing system to perform operations. According to the operations, a sand detection output of a product sand detection tool and a raw timeseries waveform corresponding to an input to the product sand detection tool are received. At least one downhole sand entry point is detected at a logging depth based on the sand detection output of the product sand detection tool. In response to the detecting of the at least one downhole sand entry point, a subset of features are extracted based on the raw timeseries waveform. Based on the extracted subset of the features and a trained Random Forest classifier, a determination is made whether the detecting of the at least one downhole sand entry point is a true positive or a false positive. A remedial action regarding the at least one downhole sand entry point is performed in response to the determining that the detection of the at least one downhole sand entry point is the true positive.

Embodiments of the disclosure may further provide a non-transitory machine-readable medium having instructions recorded thereon for a processor of a computing device to perform operations. According to the operations, a sand detection output of a product sand detection tool and a raw timeseries waveform corresponding to an input to the product sand detection tool are received. At least one downhole sand entry point at a logging depth is detected based on the sand detection output of the product sand detection tool. In response to the detecting of the at least one downhole sand entry point, a subset of features are extracted based on the raw timeseries waveform. Whether the detecting of the at least one downhole sand entry point is a true positive or a false positive is determined based on the extracted subset of the features and a trained Random Forest classifier. In response to the determining that the detecting of the at least one downhole sand entry point at the logging depth is the true positive, a remedial action regarding the at least one downhole sand entry point is performed.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures:

FIG. 7 is a table showing example probabilities of detection of a downhole sand entry point for pairs of features of the subset of features being considered for use with decision trees of a Random Forest classifier, according to an embodiment.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
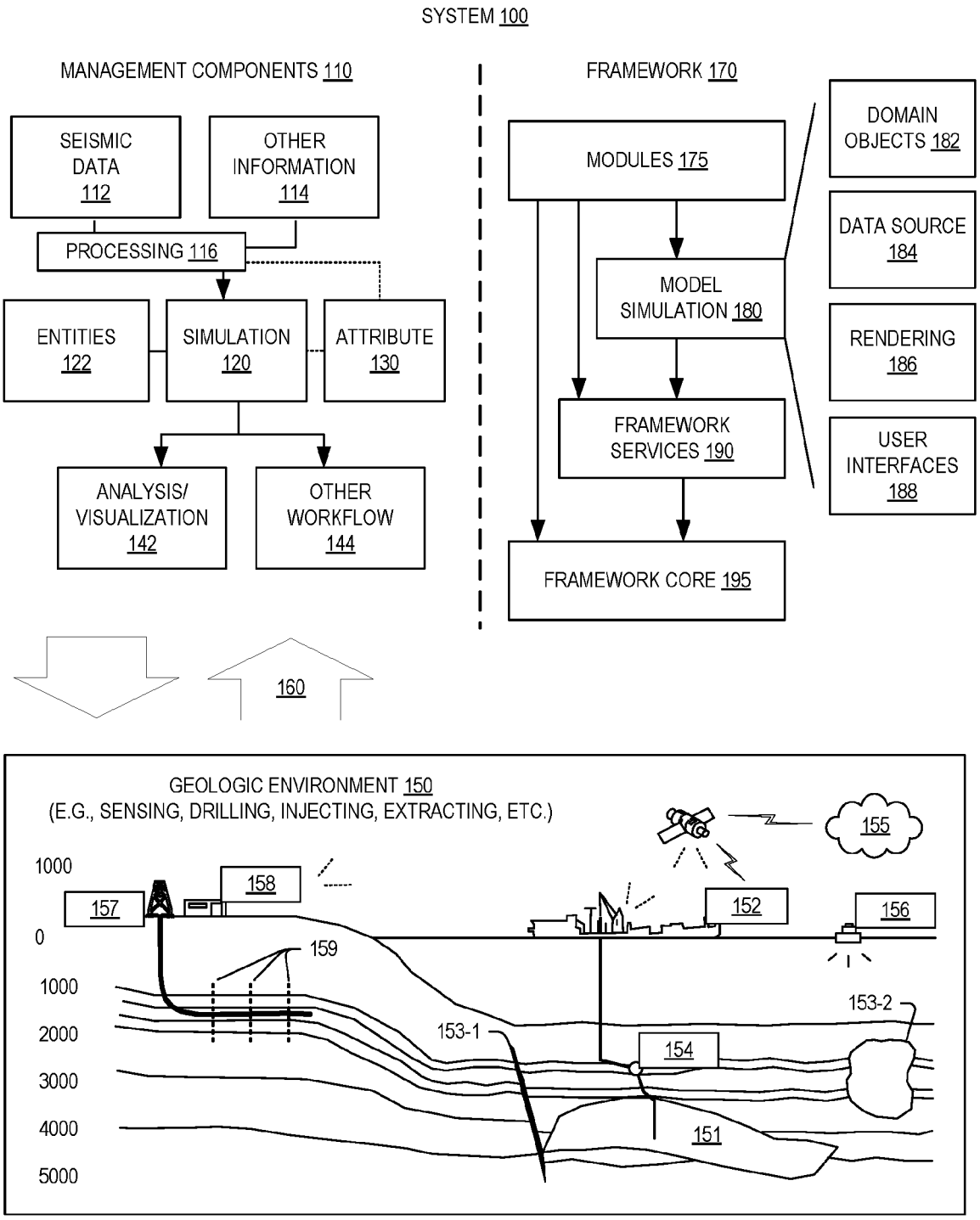
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT® .NET® framework (Redmond, Washington), which provides a set of extensible object classes. In the .NET® framework, an object class encapsulates a module of reusable code and associated data structures. Object classes can be used to instantiate object instances for use by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Texas), the INTERSECT™ reservoir simulator (Schlumberger Limited, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a workstep may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Figure 2:
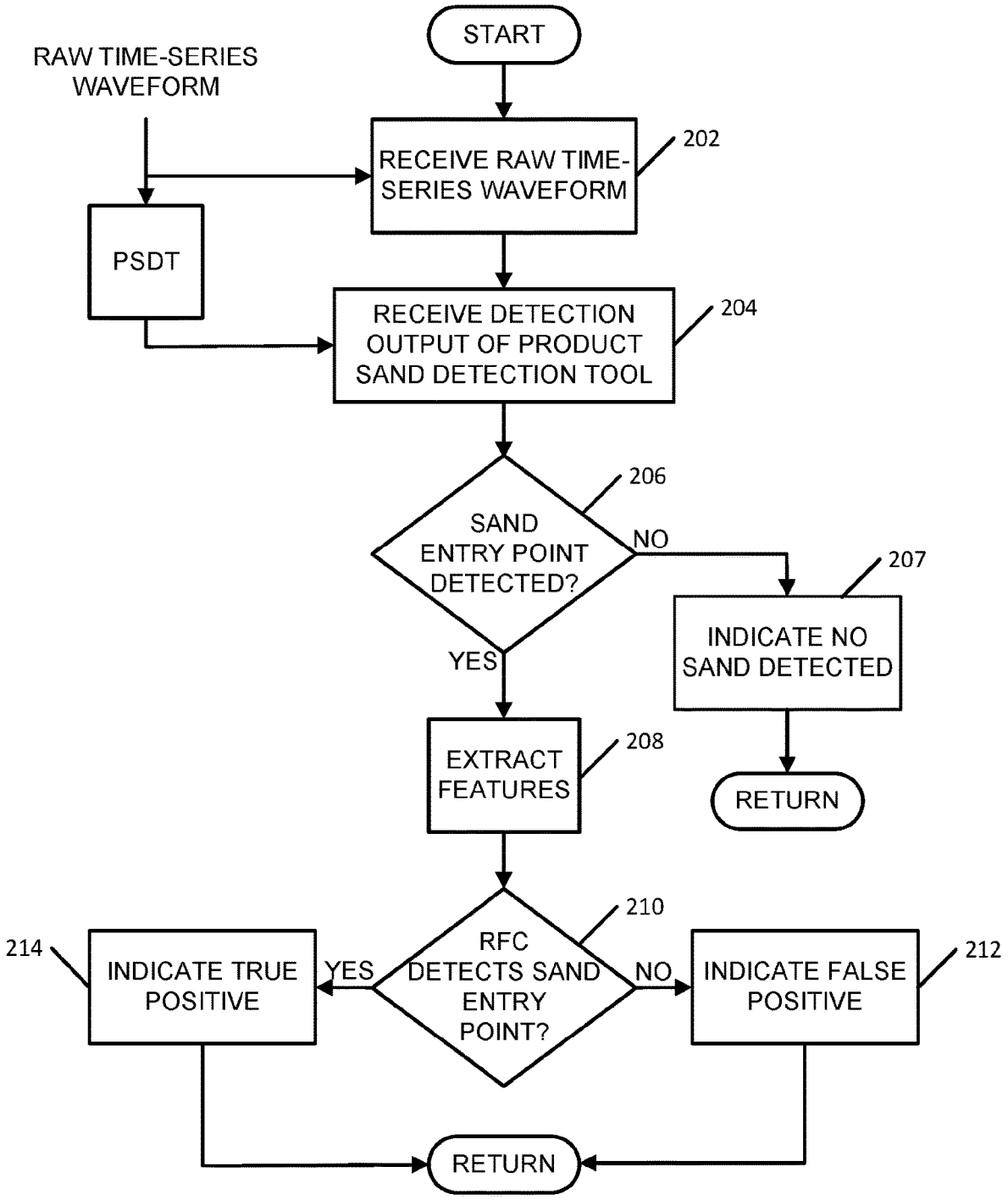
FIG. 2 is a flowchart that illustrates an example process, according to an embodiment, for determining whether a downhole sand entry point detected by a product sand detection tool is a true positive or a false positive.

FIG. 2 illustrates a flowchart of an example process that may be executed by a computing device to detect true positives and false positives with respect to output of the PDST for detecting downhole sand entry points. Due to downhole sand impacts, the PDST produces numerous false positives with respect to detection of downhole sand entry points. However, the PDST can effectively detect an absence of downhole sand.

The process may begin with a computing device receiving a raw timeseries waveform (act 202), which may also be provided as input to the PSDT. The raw time series waveform may be provided by sensors located at a downhole logging depth. The PSDT may analyze the raw timeseries waveform and may provide an output signal, which may be received by the computing device (act 204) and may indicate whether a downhole sand entry point is detected at the logging depth.

The computing device may determine whether the received output signal from the PSDT indicates that the downhole sand entry point is detected at the logging depth (act 206). If the computing device determines that the received output signal indicates that no sand was detected, then the process may indicate that no sand was detected (act 207) and the process may be completed.

Otherwise, if the computing device determines that the received output signal indicates that a downhole sand entry point was detected, the procedure may determine whether the detection of the downhole sand entry point was a true positive or a false positive by extracting a number of features based on the raw timeseries waveform (act 208) and using a binary classifier such as, for example, a trained Random Forest classifier (RFC), based on at least a subset of the extracted features, to determine whether the detection of the downhole sand entry point is the true positive or the false positive (act 210). If the binary classifier detects the sand entry point at the logging depth, then the computing device may indicate that the detection is the true positive (act 214). Otherwise, the computing device may indicate that the downhole sand entry point is the false positive (act 212). The process then may be completed.

If the true positive is determined, a remedial action may be taken. Remedial actions may include injecting artificial tackifying chemicals (e.g. agglomerants) or binders (conglomerants) into a well to stabilize formation material while maintaining sufficient permeability to enable production, or plugging of the well, as well as other remedial actions.

A set of features may be derived from the raw timeseries waveform received by the computing device, its wavelet-based noise-extracting version, and its frequency domain analysis.

Figure 3:
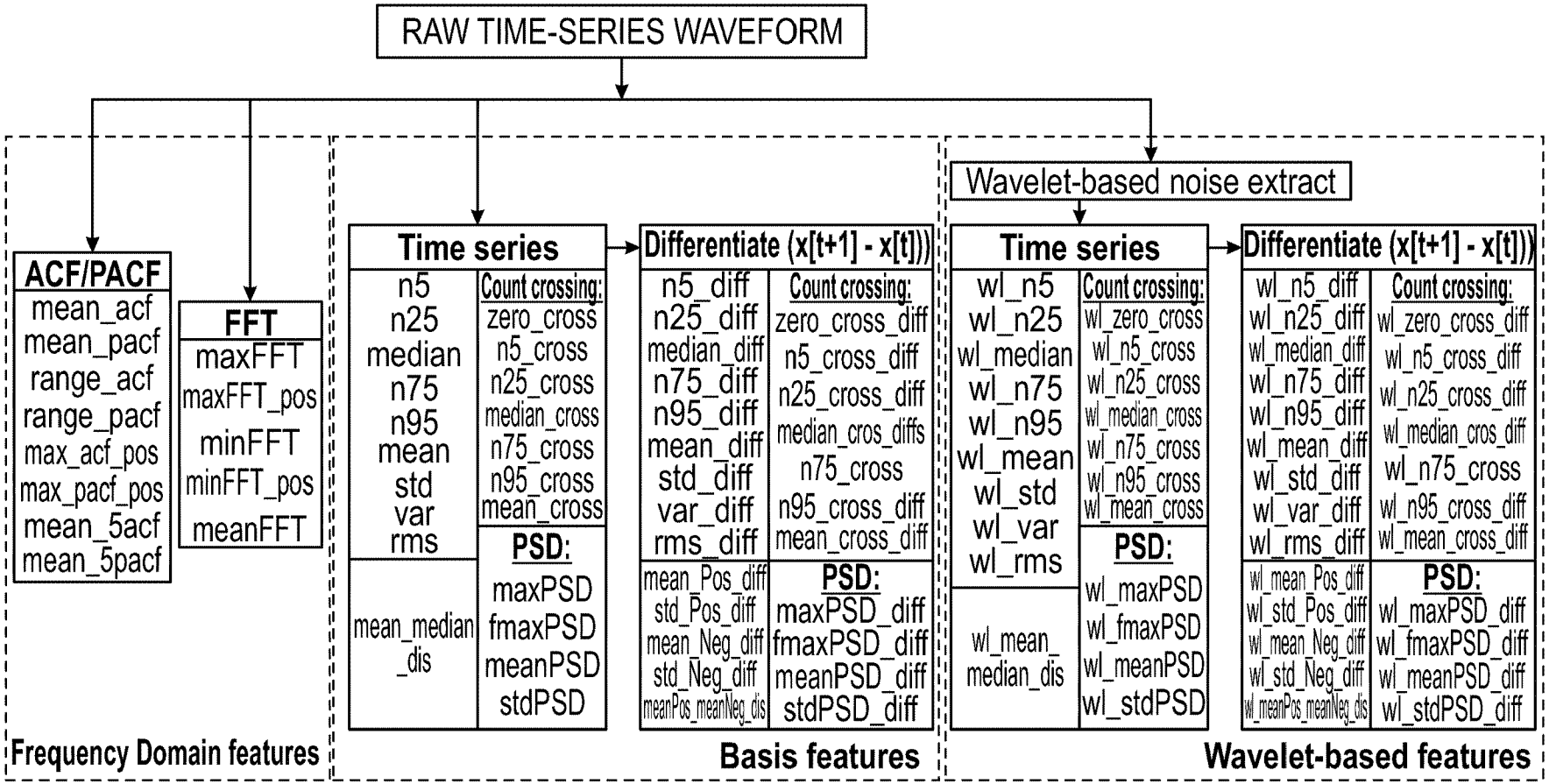
FIG. 3 illustrates an example set of features that may be considered for use with decision trees of a Random Forest classifier for detecting whether a detected sand entry point is a true positive or a false positive, according to an embodiment.

FIG. 3 shows an example set of features that may be extracted based on the raw timeseries waveform.

Basic features of the raw timeseries waveform may include:

- nX, where X can be 5, 25, 50 (median), 75 and 95, representing a percentile X of the timeseries;
- mean, std, var, and rms correspond to mean, standard deviation, variance, and root mean squared values of the timeseries;
- Y_cross, where Y may be 0, n5, n25, median, mean, n75, n95 values, denotes a number of times the timeseries crosses at level Y;
- basic power spectrum density (PSD) features may include maxPSD, mean PSD, stdPSD, and fmaxPSD, which correspond to maximum value of PSD, mean value of PSD, standard deviation value of PSD, and a frequency at which the PSD achieves a maximum value of the timeseries; and
- other basic features may include:
  - mean_median_dis, which denotes an absolute distance between a mean and a median of the timeseries;
  - mean Pos_diff and std_Pos_diff, which are the mean and standard deviation of positive elements of a first derivative of the timeseries;
  - mean_Neg_diff and std_Neg_diff, which denote the mean and standard deviation of negative elements of the first derivative of the timeseries; and
  - meanPos_meanNeg_dis, which is an absolute distance between the mean of the positive elements and the mean of the negative elements of the first derivative of the timeseries.

Figure 4A:
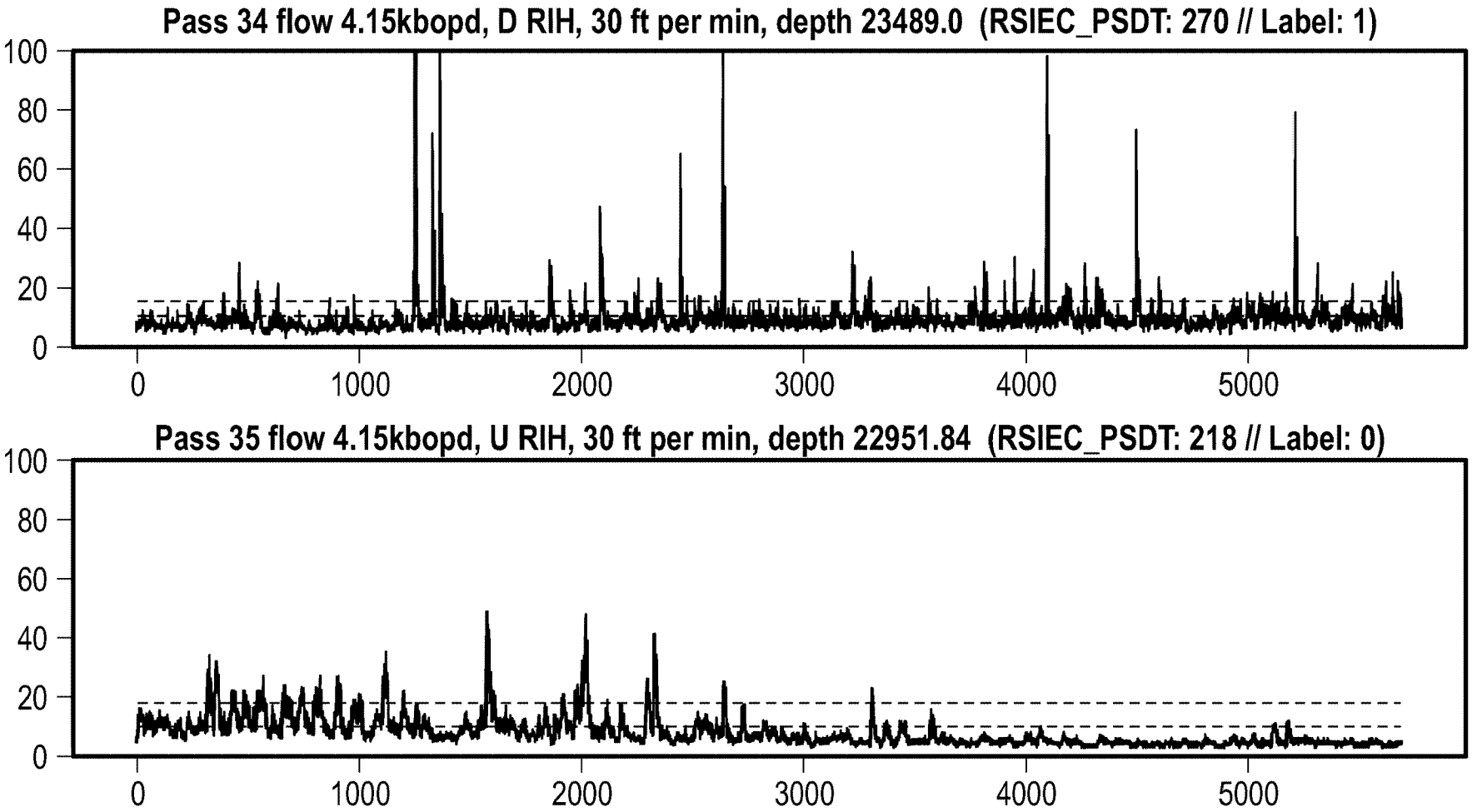
FIGS. 4A and 4B further illustrate some example basic features that may be considered for use with decision trees of a Random Forest classifier according to an embodiment.
Figure 4B:
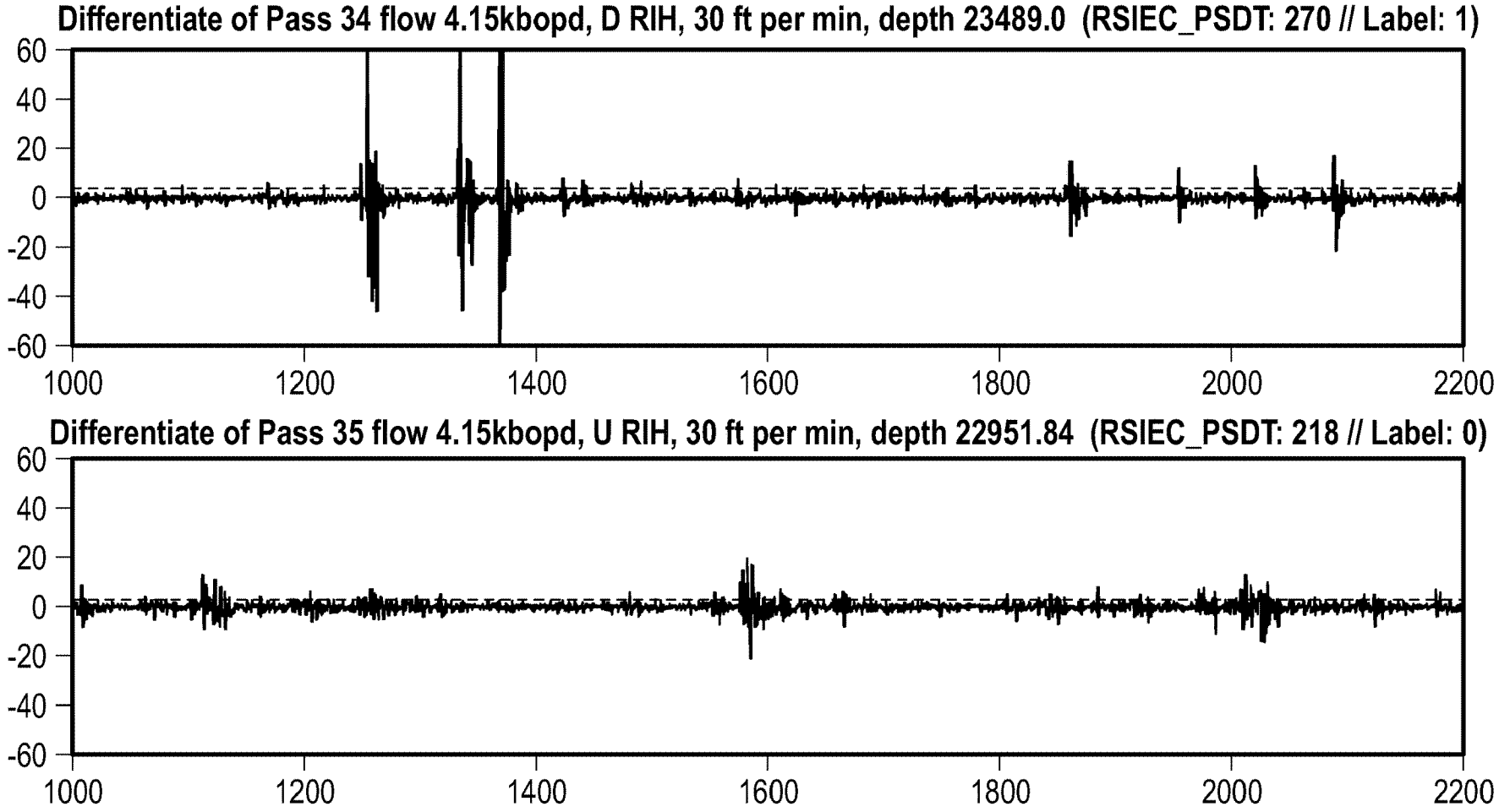

Some basic features are illustrated in FIGS. 4A and 4B.

FIG. 4A illustrates graphs of raw timeseries waveforms. In a top graph, a portion of a plotted timeseries appearing below a first dashed line at about a value of 15 of a vertical axis represents 95% of the timeseries (n95). A portion of the plotted timeseries appearing below a second plotted line at about a value of 10 of the vertical axis represents 75% of the timeseries (n75). A number of times that the timeseries crosses at level n95 (n95-cross) is 248. A number of times that the timeseries crosses at level n75 (n75_cross) is 832. In a bottom graph of FIG. 4A, a plot of a raw timeseries waveform from a different logging depth is illustrated. In this graph, a portion of the timeseries below a first dashed line at about a value of 18 of the vertical axis represents 95% of the timeseries (n95). A portion of the plotted timeseries appearing below a second dashed line at about a value of 10 of the vertical axis represent 75% of the timeseries (n95). A number of times that the timeseries crosses at level n95 (n95_cross) is 170. A number of times that the timeseries crosses at level n75 (n75_cross) is 460.

FIG. 4B illustrates graphs of a first derivative of raw timeseries waveforms. In a top graph of FIG. 4B, a portion of a plotted timeseries appearing below a dashed line at about a value of 2 of the vertical axis represents 95% of the first derivative of the timeseries waveform (n95-diff). A number of times that the first derivative of the timeseries waveform crosses at a level n95 (n95_cross_diff) is 46. A number of times that the first derivative of the timeseries waveform crosses at a level of zero (zero_cross_diff) is 35.39. A standard deviation of negative elements of the first derivative of the timeseries waveform (std_neg_diff) is 4.394. A standard deviation of positive elements of the first derivative of the timeseries waveform (std_pos_diff) is 1.717.

Figure 5:
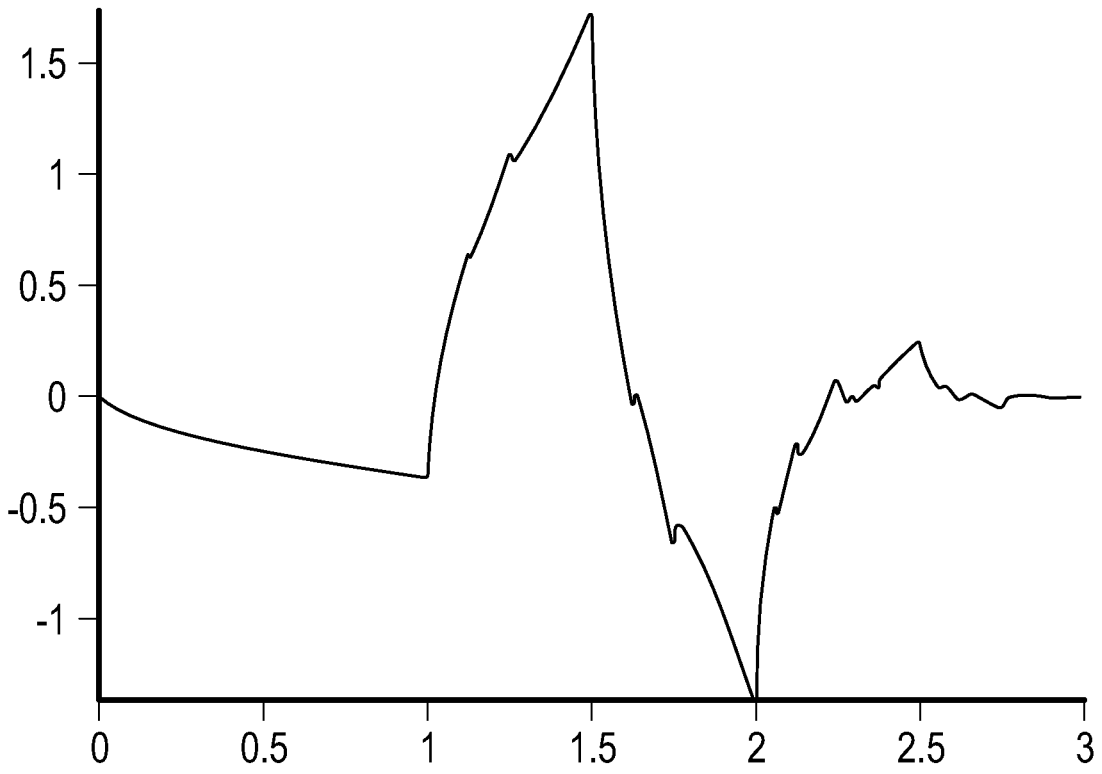
FIG. 5 illustrates an example mother wavelet function "db2" according to an embodiment.

To amplify a difference in a pulse shape of a raw timeseries waveform, a wavelet transform may be adopted to extract noise from the raw timeseries waveform. A standard form of a tunnel-jet sand peak shows exponential decay. A mother wavelet function "db2", shows a similar exponential decay as illustrated in FIG. 5. A noise portion of the raw timeseries waveform, extracted based on the wavelet transform, is used to compute a set of features similar to the set of basic features. To distinguish the features based on the wavelet transform, a prefix "wl_" is added to feature notations, as shown in FIG. 3.

In addition to power spectral density (PSD) features, which are computed for the raw timeseries waveform and the wavelet-based extracted noise waveform, features in a frequency domain may be calculated based on a fast Fourier transform (FFT), an autocorrelation function (ACF), and a partial autocorrelation function (PACF) of the raw timeseries waveform. These are presented in this specification as follows:

- maxFFT, minFFT, and mean FFT, respectively, are a maximum value, a minimum value, and a mean value of the FFT;
- maxFFT pos and minFFT pos, respectively, are a position of a maximum FFT and a position of a minimum FFT;
- mean_5acf and mean_5pacf, respectively, are an average of a first five coefficients of the ACF and an average of a first five coefficients of the PACF;
- mean_acf and mean pacf, respectively, are an average of a first forty coefficients of the ACF and an average of a first forty coefficients of the PACF;
- range_acf and range pacf, respectively, are distances between highest and lowest values of the first forty coefficients of the ACF and the first forty coefficients of the PACF; and
- max_acf pos and max pacf pos, respectively, are a position of the maximum of the first forty coefficients of the ACF and a position of the maximum of the first forty coefficients of the PACF.

As discussed above, there are many features that may be extracted based on a raw timeseries waveform. In various embodiments, some features may be eliminated as candidates for a subset of features that may be considered for forming decision trees of a Random Forest classifier. Based on a data set that includes expert labels for true and false downhole sand entry point detection, collinear and low importance features may be removed from consideration for use with decision trees of an RFC according to a following criteria:

i) features with a single unique value;
ii) features with a correlation magnitude greater than 0.9; and
iii) features that do not contribute to a cumulative importance of 0.9.

To implement criterion (ii), a Pearson correlation score is used to cluster groups of features based on an Agglomerative Hierarchical Clustering algorithm with a magnitude correlation threshold of 0.9. Then, only one representative feature with a highest correlation to a target label is selected from each group and remaining features from the each group are removed from consideration for use with the decision trees of the RFC.

To implement criterion (iii), a simple RFC is used to train with the data set. An importance score based on a Gini impurity measure is used for removing features that do not contribute to a cumulative importance of 0.9.

Figure 6:
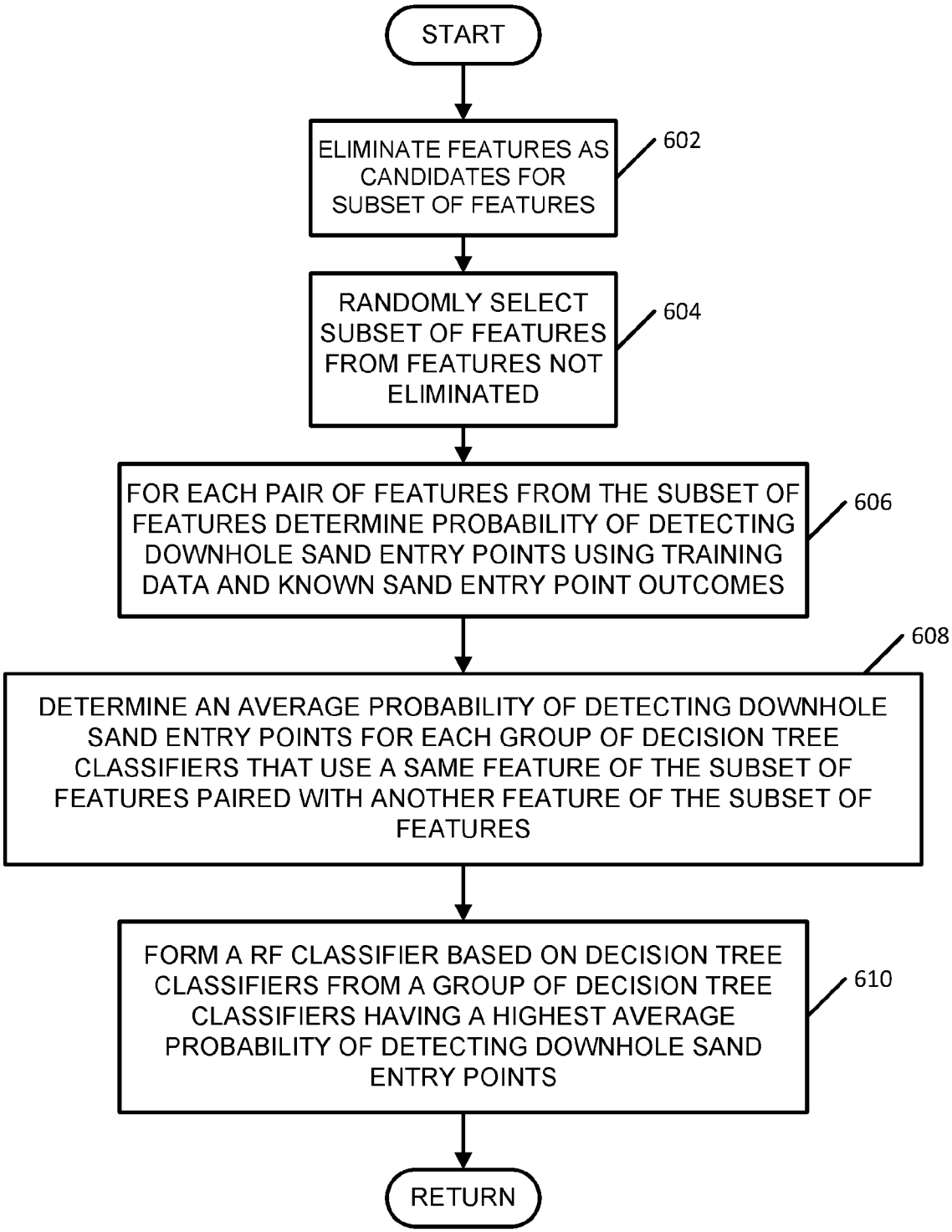
FIG. 6 is a flowchart of an example process that may be executed by a computing device, according to an embodiment, for eliminating some of the features as candidates for a subset of features to be considered for use with decision trees of a Random Forest classifier, and for selecting the subset of features to be used with the decision trees of the Random Forest classifier.

FIG. 6 is a flowchart that illustrates a process that may be performed, according to some embodiments, by a computing device to eliminate some of the features as candidates for a subset of features, based on a raw timeseries waveform, and choosing features, from a group of features not eliminated as the candidates, to be considered for forming decision trees of an RFC.

The process may begin with the computing device eliminating features from being candidates for the subset of features to be considered for use in forming decision trees for a RFC, as previously discussed (act 602). Next, a subset of remaining features not eliminated as being the candidates may be randomly selected (act 604). Next, the computing device may determine, for each pair of features from the randomly selected subset of features, a probability of detecting a downhole sand entry point, given that the PDST provided a true outcome with respect to detection of the downhole sand entry point. The probability may be determined based on using training data and expert labels indicating known sand entry point detection outcomes (act 606). An average probability of detecting a downhole sand entry point may be calculated for each group of decision tree classifiers that use a same feature of the subset of features paired with another feature of the subset of features (act 608). Following act 608, the computing device may form an RFC based on a group of the decision tree classifiers having a highest average probability of detecting downhole sand entry points with respect to other groups of decision tree classifiers (act 610). In some embodiments, decision tree classifiers may be limited to a depth of 4.

FIG. 7 is a table showing example probabilities of detection of a downhole sand entry point, given that the PDST reported true with respect to detection of the downhole sand entry point, for decision trees based on the subset of features and training data including expert labels regarding downhole sand entry points. In FIG. 7, the features include std_neg_diff, wl_std_diff, wl_zero_cross_diff, mean_5acf, mean_5acf, and mean_5pcf.

Looking at FIG. 7, it is clear that the column that is labeled "mean_5acf" has a highest average probability of detecting a downhole sand entry point, given that the PDST reported detection of the downhole sand entry point. Thus, an RFC may be formed using decision trees based on the feature mean_5acf paired with any of the features std_neg_diff, wl_std_diff, wl_zero_cross_diff, and mean_5pacf.

Figure 8:
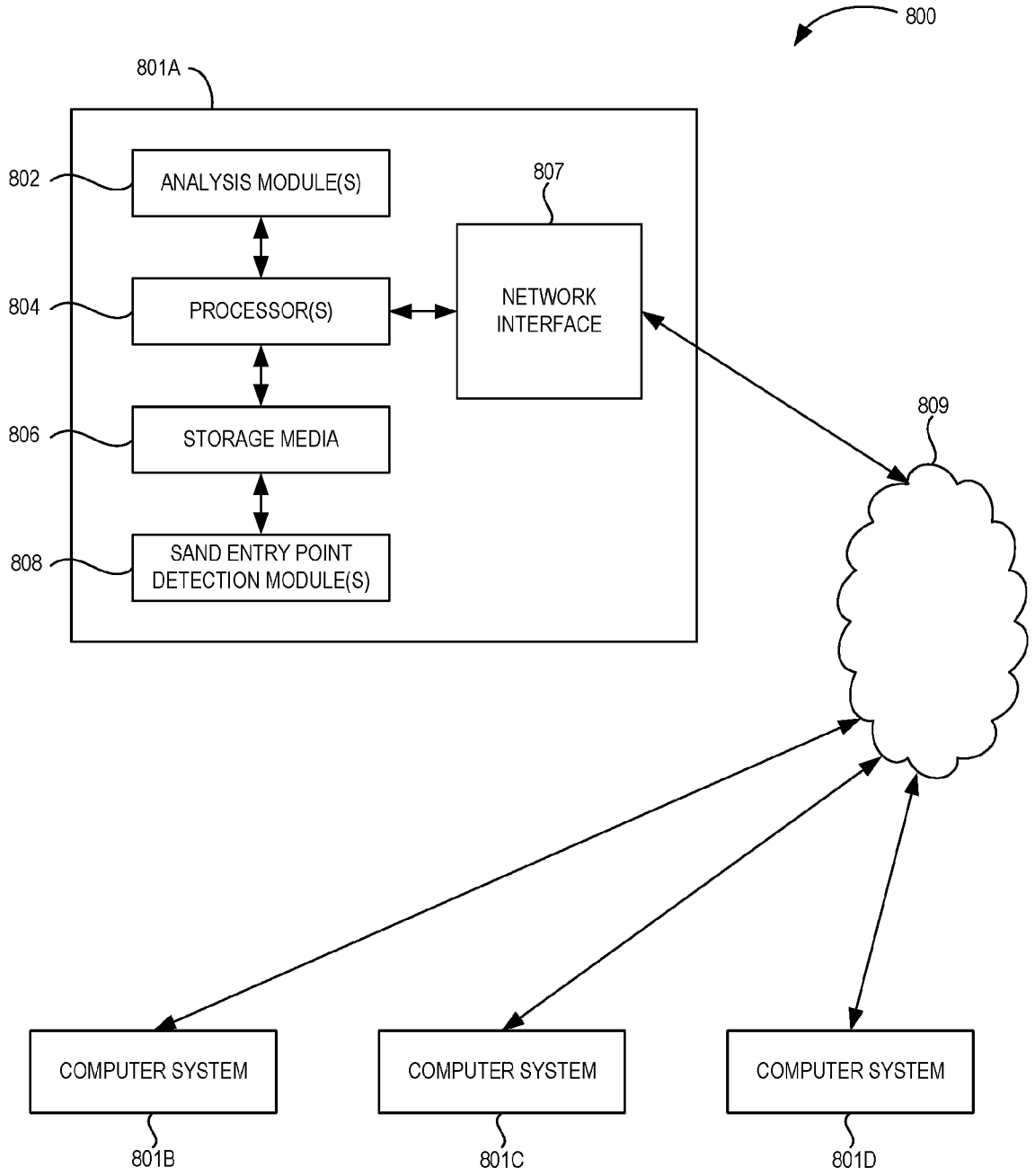
FIG. 8 illustrates a schematic view of a computing system, according to an embodiment.

In some embodiments, the methods of the present disclosure may be executed by a computing system. FIG. 8 illustrates an example of such a computing system 800, in accordance with some embodiments. The computing system 800 may include a computer or computer system 801A, which may be an individual computer system 801A or an arrangement of distributed computer systems. The computer system 801A includes one or more analysis modules 802 that are configured to perform various tasks according to some embodiments, such as one or more methods disclosed herein. To perform these various tasks, the analysis module 802 executes independently, or in coordination with, one or more processors 804, which is (or are) connected to one or more storage media 806. The processor(s) 804 is (or are) also connected to a network interface 807 to allow the computer system 801A to communicate over a data network 809 with one or more additional computer systems and/or computing systems, such as 801B, 801C, and/or 801D (note that computer systems 801B, 801C and/or 801D may or may not share the same architecture as computer system 801A, and may be located in different physical locations, e.g., computer systems 801A and 801B may be located in a processing facility, while in communication with one or more computer systems such as 801C and/or 801D that are located in one or more data centers, and/or located in varying countries on different continents).

A processor may include a microprocessor, microcontroller, processor module or subsystem, programmable integrated circuit, programmable gate array, or another control or computing device.

The storage media 806 may be implemented as one or more computer-readable or machine-readable storage media. Note that while in the example embodiment of FIG. 8, storage media 806 is depicted as within computer system 801A, in some embodiments, storage media 806 may be distributed within and/or across multiple internal and/or external enclosures of computer system 801A and/or additional computer systems. Storage media 806 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 800 contains one or more sand entry point detection modules 808. In the example of computing system 800, computer system 801A includes the sand entry point detection module(s) 808. In some embodiments, a single sand entry point detection module 808 may be used to perform some aspects of one or more embodiments of the methods disclosed herein. In other embodiments, a plurality of sand entry point detection modules 808 may be used to perform some aspects of methods herein.

It should be appreciated that computing system 800 is merely one example of a computing system, and that computing system 800 may have more or fewer components than shown, may combine additional components not depicted in the example embodiment of FIG. 8, and/or computing system 800 may have a different configuration or arrangement of the components depicted in FIG. 8. The various components shown in FIG. 8 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAS, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 800, FIG. 8), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosed embodiments and various embodiments with various modifications as are suited to the particular use contemplated.

What is claimed is:

1. A method for detecting downhole sand entry points, the method comprising:

receiving, by a computing device, a sand detection output of a product sand detection tool and a raw timeseries waveform corresponding to an input to the product sand detection tool;

detecting, by the computing device, at least one downhole sand entry point at a logging depth based on the sand detection output of the product sand detection tool;

responsive to the detecting of the at least one downhole sand entry point, performing:

extracting, by the computing device, a subset of features based on the raw timeseries waveform, training a Random Forest classifier to produce a trained Random Forest classifier, the training further comprising:

randomly selecting, by the computing device, the features based on the raw timeseries waveform to produce the subset of features;

determining, by the computing device, which paired features of the subset of features have a higher average detection probability than others of the paired features based on using a training set of the features and known sand entry point outcomes; and constructing, by the computing device, the trained Random Forest classifier based on a plurality of decision trees, each of the decision trees being based on a respective pair of the paired features of the subset of features having the higher average detection probability, determining, by the computing device, the detecting of the at least one downhole sand entry point is correct based on the extracted subset of features and the trained Random Forest classifier, and performing a remedial action regarding the at least one downhole sand entry point in response to the determining that the detecting is correct.

2. The method of claim 1, further comprising:

eliminating, by the computing device, as candidates for the subset of features the features with a single unique value, the features with a correlation magnitude greater than 0.9 with respect to another of the features, and the features that do not contribute to a cumulative importance of at least 0.9, wherein:

the randomly selecting of the features based on the raw timeseries waveform to produce the subset of features further comprises:

randomly selecting the subset of features from the features not eliminated as the candidates for the subset of features.

3. The method of claim 1, further comprising:

determining, by the computing device, a probability of sand entry point detection based on decision trees formed from each feature of the subset of features paired with another feature of the subset of features;

determining, by the computing device, an average probability of sand entry point detection of each of the decision trees that pairs a same one of the subset of features with each different respective one of the subset of features;

determining, by the computing device, which group of the decision trees that pairs the same one of the subset of features with the each different respective one of the subset of features has a highest average probability of the sand entry point detection; and selecting, by the computing device, a pair of the subset of features for the decision trees of the trained Random Forest classifier based on the group of the decision trees that pairs the same one of the subset of features with the each different respective one of the subset of features having the highest average probability of the sand entry point detection.

4. The method of claim 1, further comprising:

creating, by the computing device, a wavelet transform of the raw timeseries waveform;

extracting, by the computing device, a noise portion of the wavelet waveform; and extracting, by the computing device, at least some of the features based on the noise portion of the wavelet transform.

5. The method of claim 1, wherein the extracted features comprise frequency domain features, basic features, and wavelet-based features.

6. A computing system for detecting downhole sand entry points, the computing system comprising:

at least one processor; and a memory connected with the at least one processor, wherein the memory includes instructions for configuring the computing system to perform operations comprising:

receiving a sand detection output of a product sand detection tool and a raw timeseries waveform corresponding to an input to the product sand detection tool;

detecting at least one downhole sand entry point at a logging depth based on the sand detection output of the product sand detection tool;

responsive to the detecting of the at least one downhole sand entry point, performing:

extracting a subset of features based on the raw timeseries waveform, training a Random Forest classifier to produce the trained Random Forest classifier, the training further comprising:

randomly selecting the features based on the raw timeseries waveform to produce the subset of features;

determining which paired features of the subset of features have a higher average sand entry point detection probability than others of the paired features based on using a training set of the features and known sand entry point outcomes; and constructing, by the computing device, the trained Random Forest classifier based on a plurality of decision trees, each of the decision trees being based on a respective pair of the paired features of the subset of features having the higher average sand entry point detection probability, determining the detecting of the at least one downhole sand entry point is correct based on the extracted subset of features and the trained Random Forest classifier, and performing a remedial action regarding the at least one downhole sand entry point in response to the determining that the detecting is correct.

7. The computing system of claim 6, wherein the operations further comprise:

eliminating as candidates for the subset of features the features with a single unique value, the features with a correlation magnitude greater than 0.9 with respect to another of the features, and the features that do not contribute to a cumulative importance of at least 0.9, wherein:

the randomly selecting of the features based on the raw timeseries waveform to produce the subset of features further comprises:

randomly selecting the subset of features from the features not eliminated as the candidates for the subset of features.

8. The computing system of claim 6, wherein the operations further comprise:

determining a probability of sand entry point detection based on decision trees formed from each feature of the subset of features paired with another feature of the subset of features;

determining an average probability of sand entry point detection of each of the decision trees that pairs a same one of the subset of features with each different respective one of the subset of features;

determining which group of the decision trees that pairs the same one of the subset of features with the each different respective one of the subset of features has a highest average probability of the sand entry point detection; and selecting a pair of the subset of features for the decision trees of the trained Random Forest classifier based on the group of the decision trees that pairs the same one of the subset of features with the each different respective one of the subset of features having the highest average probability of the sand entry point detection.

9. The computing system of claim 6, wherein the operations further comprise:

creating a wavelet transform of the raw timeseries waveform;

extracting a noise portion of the wavelet waveform; and extracting at least some of the features based on the noise portion of the wavelet transform.

10. The computing system of claim 6, wherein the trained Random Forest classifier comprises decision tree classifiers with a maximum depth of 4.

11. A non-transitory machine-readable medium having instructions recorded thereon for a processor of a computing device to perform operations comprising:

receiving a sand detection output of a product sand detection tool and a raw timeseries waveform corresponding to an input to the product sand detection tool;

detecting at least one downhole sand entry point at a logging depth based on the sand detection output of the product sand detection tool;

responsive to the detecting of the at least one downhole sand entry point, performing:

extracting a subset of features based on the raw timeseries waveform, training a Random Forest classifier to produce the trained Random Forest classifier, the training further comprising:

randomly selecting the features based on the raw timeseries waveform to produce the subset of features;

determining which paired features of the subset of features have a higher average sand entry point detection probability than others of the paired features based on using a training set of the features and known sand entry point outcomes; and constructing, by the computing device, the trained Random Forest classifier based on a plurality of decision trees, each of the decision trees being based on a respective pair of the paired features of the subset of features having the higher average sand entry point detection probability, determining the detecting of the at least one downhole sand entry point is correct based on the extracted subset of features and the trained Random Forest classifier, and performing a remedial action regarding the at least one downhole sand entry point in response to the determining that the detecting is the true positive correct.

12. The non-transitory machine-readable medium of claim 11, wherein the operations further comprise:

eliminating as candidates for the subset of features the features with a single unique value, the features with a correlation magnitude greater than 0.9 with respect to another of the features, and the features that do not contribute to a cumulative importance of at least 0.9, wherein:

the randomly selecting of the features based on the raw timeseries waveform to produce the subset of features further comprises:

randomly selecting the subset of features from the features not eliminated as the candidates for the subset of features.

13. The non-transitory machine-readable medium of claim 11, wherein the operations further comprise:

determining a probability of sand entry point detection based on decision trees formed from each feature of the subset of features paired with another feature of the subset of features;

determining an average probability of sand entry point detection of each of the decision trees that pairs a same one of the subset of features with each different respective one of the subset of features;

determining which group of the decision trees that pairs the same one of the subset of features with the each different respective one of the subset of features has a highest average probability of the sand entry point detection; and selecting a pair of the subset of features for the decision trees of the trained Random Forest classifier based on the group of the decision trees that pairs the same one of the subset of features with the each different respective one of the subset of features for the decision trees having the highest average probability of the sand entry point detection.

14. The non-transitory machine-readable medium of claim 11, wherein the trained Random Forest classifier comprises decision tree classifiers with a maximum depth of 4.

* * * * *